US005428376A

United States Patent [19]

Wade et al.

[11] Patent Number: 5,428,376

[45] Date of Patent: Jun. 27, 1995

[54] THERMAL TURN ON ENERGY TEST FOR AN INKJET PRINTER

[75] Inventors: John M. Wade, Poway; Brian P. Canfield, San Diego, both of Calif.; Kurt K. Andersen, Manchester, Mo.; Hanno Ix, Escondido, Calif.

[73] Assignee: Hewlett-Packard Company, Palo Alto, Calif.

[21] Appl. No.: 145,904

[22] Filed: Oct. 29, 1993

[51] Int. Cl.[6] ..... B41J 2/01

[52] U.S. Cl. ..... 347/14; 347/19

[58] Field of Search ..... 347/57, 17, 19, 14

[56] References Cited

U.S. PATENT DOCUMENTS 5,223,853 6/1993 Wysocki et al. ..... 347/14

5,365,257 11/1994 Minowa et al. ..... 347/17

FOREIGN PATENT DOCUMENTS 5-169644 7/1993 Japan ..... 347/17

*Primary Examiner*—Benjamin R. Fuller

*Assistant Examiner*—Craig A. Hallacher

*Attorney, Agent, or Firm*—Dennis G. Stenstrom

[57] ABSTRACT

A method for operating a thermal ink jet printer including a printhead having ink firing heater resistors responsive to pulses provided to the printhead. Warming voltage pulses are applied to the printhead to warm the printhead to a temperature that is at least as high as a temperature that would be produced pursuant to ink firing pulses of a predetermined voltage, a predetermined pulse width, and a predetermined pulse frequency. A continuous series of ink firing pulses are then applied to the printhead, starting with a pulse energy substantially equal to the predetermined reference pulse energy and a pulse frequency equal to the predetermined pulse frequency, and then incrementally decreasing the pulse energy of the ink firing pulses. The temperature of the printhead is repeatedly sampled while the ink firing pulses are applied to the ink firing resistors to produce a set of temperature samples respectively associated with the decreasing pulse energies. A thermal turn on energy is determined from the temperature samples, and the printhead is operated at a pulse energy that is greater than the thermal turn on energy and in a range that provides a desired print quality while avoiding premature failure of the heater resistors.

6 Claims, 7 Drawing Sheets

NORMALIZED VOLUME AND TEMPERATURE DATA

B
C
D
SAMPLE(I) >MIN+D3 ?
145
NO
YES
SET TEST OK FLAG TO TRUE
147
SAMPLE(I) <MIN+D4 ?
149
NO
YES
SUPPLY VOLTAGE AT PREDETERMINED MINIMUM ?
151
YES
NO
DELAY UNTIL DOWN COUNTING TIMER IS AT 0
152
REDUCE POWER SUPPY VOLTAGE BY PREDETERMINED AMOUNT
153
STOP APPLICATION OF INK FIRING PULSES
154
E
F

THERMAL TURN ON ENERGY TEST FOR AN INKJET PRINTER

BACKGROUND OF THE INVENTION

The subject invention relates generally to thermal ink jet printers, and is directed more particularly to a technique for determining the thermal turn on energy of a thermal ink jet printhead while the printhead is installed in a printer.

An ink jet printer forms a printed image by printing a pattern of individual dots at particular locations of an array defined for the printing medium. The locations are conveniently visualized as being small dots in a rectilinear array. The locations are sometimes called "dot locations", "dot positions", or "pixels". Thus, the printing operation can be viewed as the filling of a pattern of dot locations with dots of ink.

Ink jet printers print dots by ejecting very small drops of ink onto the print medium, and typically include a movable carriage that supports one or more printheads each having ink ejecting nozzles. The carriage traverses over the surface of the print medium, and the nozzles are controlled to eject drops of ink at appropriate times pursuant to command of a microcomputer or other controller, wherein the timing of the application of the ink drops is intended to correspond to the pattern of pixels of the image being printed.

The printheads of thermal ink jet printers are commonly implemented as replaceable printhead cartridges which typically include one or more ink reservoirs and an integrated circuit printhead that includes a nozzle plate having an array of ink ejecting nozzles, a plurality of ink firing chambers adjacent respective nozzles, and a plurality of heater resistors adjacent the firing chambers opposite the ink ejecting nozzles and spaced therefrom by the firing chambers. Each heater resistor causes an ink drop to be fired from its associated nozzle in response to an electrical pulse of sufficient energy.

A thermal ink jet printhead requires a certain minimum energy to fire ink drops of the proper volume (herein called the turn on energy). Turn on energy can be different for different printhead designs, and in fact varies among different samples of a given printhead design as a result of manufacturing tolerances. As a result, thermal ink jet printers are configured to provide a fixed ink firing energy that is greater than the expected highest turn on energy for the printhead cartridges it can accommodate.

A consideration with utilizing a fixed ink firing energy is that firing energies excessively greater than the actual turn on energy of a particular printhead cartridge result in a shorter operating lifetime for the heater resistors and degraded print quality. Another consideration with utilizing a fixed ink firing energy is the inability to utilize newly developed or revised printheads that have ink firing energy requirements that are different from those for which existing thermal ink jet printers have been configured.

It would be possible for a printhead cartridge manufacturer to test each printhead for turn on energy prior to distribution, but known techniques for determining turn-on energy (e.g., by detecting ink drop volume or ink drop velocity) are complex and time consuming, and are not readily adapted to production manufacturing. Moreover, the turn on energy of a printhead might not remain constant throughout its useful life.

SUMMARY OF THE INVENTION

It would therefore be an advantage to provide a thermal ink jet printer that determines a thermal turn on energy of a thermal ink jet printhead while the printhead is installed in the printer.

The foregoing and other advantages are provided by the invention in a method that includes the steps of (a) warming voltage pulses are applied to the ink firing heater resistors of the printhead to warm the printhead to a temperature that is higher than a temperature that would be produced pursuant to ink firing pulses of a predetermined voltage, a predetermined pulse width, and a predetermined pulse frequency; (b) applying a continuous series of ink firing pulses to the heater resistors, starting with a pulse energy substantially equal to the predetermined reference pulse energy and a pulse frequency equal to the predetermined pulse frequency, and then incrementally decreasing the pulse energy of the ink firing pulses; (c) repeatedly sampling the temperature of the printhead while the ink firing pulses are applied to the ink firing resistors to produce a set of temperature data samples respectively associated with the decreasing pulse energies; (d) determining an equation of a curve that is fitted to the temperature data samples; (e) determining a thermal turn on energy from the equation; and (f) operating the printhead at a pulse energy that is greater than the thermal turn on energy and in a range that provides good print quality while avoiding premature failure of the heater resistors.

BRIEF DESCRIPTION OF THE DRAWINGS

The advantages and features of the disclosed invention will readily be appreciated by persons skilled in the art from the following detailed description when read in conjunction with the drawing wherein.

DETAILED DESCRIPTION OF THE DISCLOSURE

Figure 1:
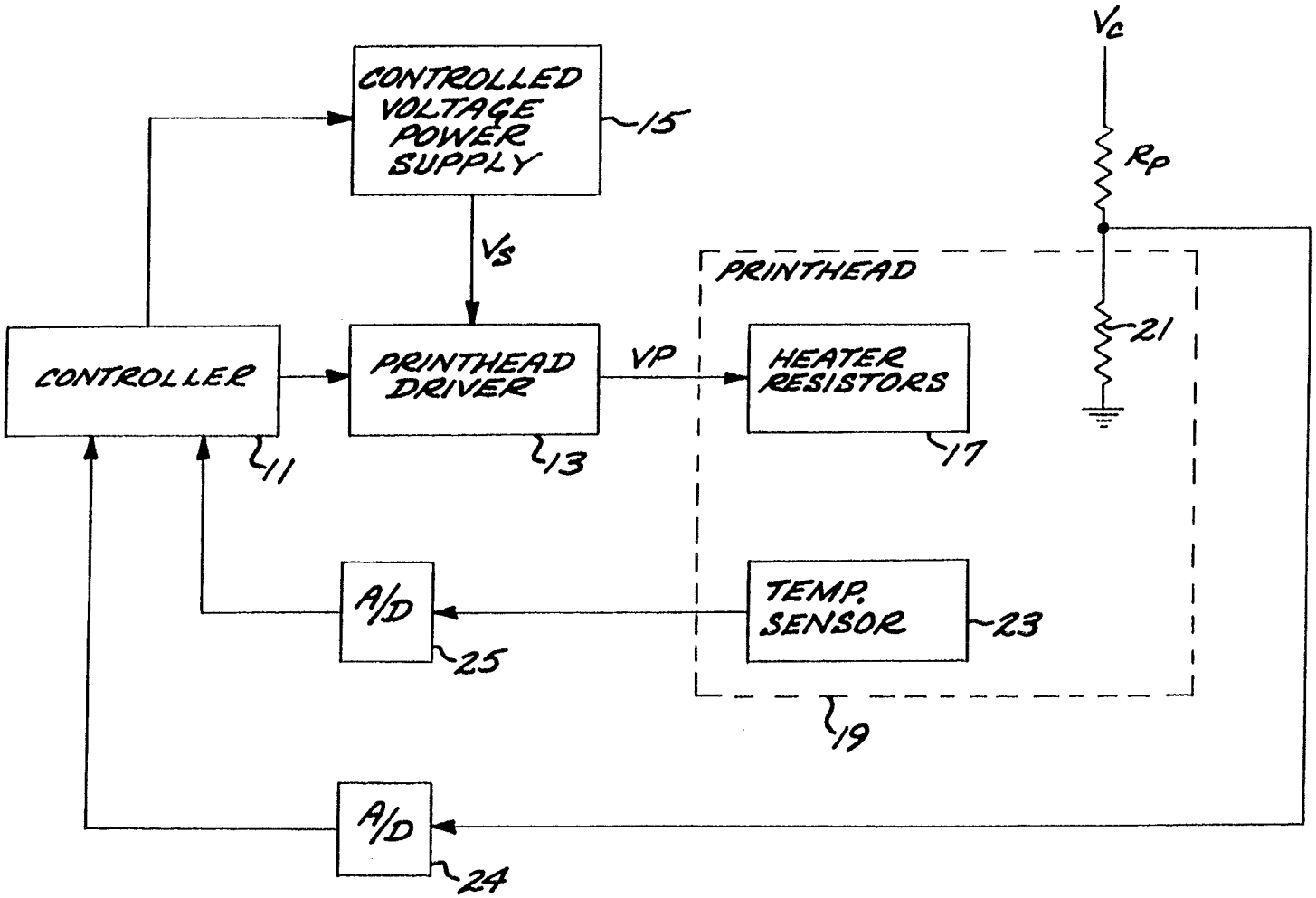
FIG. 1 is a schematic block diagram of the thermal ink jet components for implementing the invention.

In the following detailed description and in the several figures of the drawing, like elements are identified with like reference numerals.

Referring now to FIG. 1, shown therein is a simplified block diagram of a thermal ink jet printer that employs the techniques of the invention. A controller 11 receives print data input and processes the print data to provide print control information to a printhead driver circuit 13. A controlled voltage power supply 15 provides to the printhead driver circuit 13 a controlled supply voltage $V_s$ whose magnitude is controlled by the controller 11. The printhead driver circuit 13, as controlled by the controller 11, applies driving or energizing voltage pulses of voltage VP to a thin film integrated circuit thermal ink jet printhead 19 that includes thin film ink drop firing heater resistors 17. The voltage pulses VP are typically applied to contact pads that are connected by conductive traces to the heater resistors, and therefore the pulse voltage received by an ink firing resistor is typically less than the pulse voltage VP at the printhead contact pads. Since the actual voltage across a heater resistor cannot be readily measured, turn on energy for a heater resistor as described herein will be with reference to the voltage applied to the contact pads of the printhead cartridge associated with the heater resistor. The resistance associated with a heater resistor will be expressed in terms of pad to pad resistance of a heater resistor and is interconnect circuitry (i.e., the resistance between the printhead contact pads associated with a heater resistor).

The relation between the pulse voltage VP and the supply voltage $V_s$, will depend on the characteristics of the driver circuitry. For example, the printhead driver circuit can be modelled as a substantially constant voltage drop $V_d$, and for such implementation the pulse voltage VP is substantially equal to the supply voltage $V_s$ reduced by the voltage drop $V_d$ of the driver circuit:

$$VP = V_s - V_d \quad \text{(Equation 1)}$$

If the printhead driver is better modelled as having a resistance $R_d$, then the pulse voltage is expressed as:

$$VP = V_s(R_p/(R_d + R_p)) \quad \text{(Equation 2)}$$

wherein $R_p$ is the pad to pad resistance associated with a heater resistor.

The controller 11, which can comprise a microprocessor architecture in accordance with known controller structures, more particularly provides pulse width and pulse frequency parameters to the printhead driver circuitry 13 which produces drive voltage pulses of the width and frequency as selected by the controller, and with a voltage VP that depends on the supply voltage $V_s$ provided by the voltage controlled power supply 15 as controlled by the controller 11. Essentially, the controller 11 controls the pulse width, frequency, and voltage of the voltage pulses applied by the driver circuit to the heater resistors.

As with known controller structures, the controller 11 would typically provide other functions such as control of the movement of the printhead carriage (not shown) and control of movement of the print media.

The integrated circuit printhead of the thermal ink jet printer of FIG. 1 further includes a sample resistor 21 having a precisely defined resistance ratio relative to each of the heater resistors, which is readily achieved with conventional integrated circuit thin film techniques. By way of illustrative example, the resistance sample resistor and its interconnect circuit are configured to have a pad to pad resistance that is the sum of (a) 10 times the resistance of each of the heater resistors and (b) the resistance of an interconnect circuit for a heater resistor. One terminal of the sample resistor is connected to ground while its other terminal is connected to one terminal of a precision reference resistor $R_p$ that is external to the printhead and has its other terminal connected to a voltage reference $V_c$. The junction between the sample resistor 21 and the precision resistor $R_p$ is connected to an analog-to-digital converter 24. The digital output of the A/D converter 24 comprises quantized samples of the voltage at the junction between the sample resistor 21 and the precision resistor $R_p$. Since the value of the precision resistor $R_p$ is known, the voltage at the junction between the sample resistor 21 and the precision resistor $R_p$ is indicative of the pad to pad resistance of the sample resistor 21 which in turn is indicative of the resistance of the heater resistors.

As discussed more fully herein, the sample resistor 21 can be utilized to determine the pad to pad resistance associated with the heater resistors in order to determine the energy provided to the heater resistors as a function of the voltage VP and pulse width of the voltage pulses provided by the driver circuit.

The integrated circuit printhead of the thermal ink jet printer of FIG. 1 also includes a temperature sensor 23 located in the proximity of some of the heater resistors, and provides an analog electrical signal representative of the temperature of the integrated circuit printhead. The analog output of the temperature sensor 21 is provided to an analog-to-digital (A/D) converter 25 which provides a digital output to the controller 11. The digital output of the A/D converter 25 comprises quantized samples of the analog output of the temperature sensor 21. The output of the A/D converter is indicative of the temperature detected by the temperature sensor.

Figure 2:
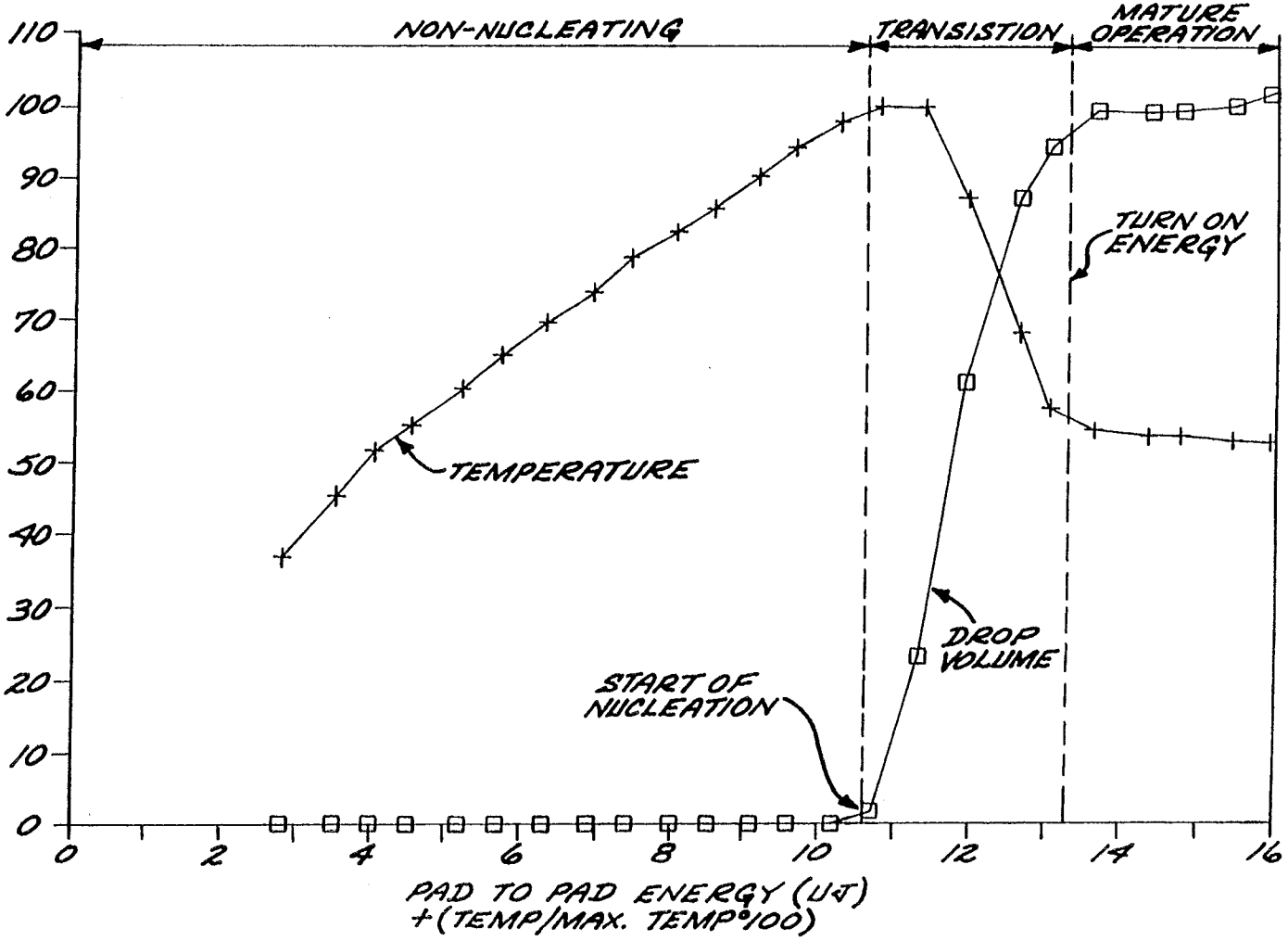
FIG. 2 is a graph showing printhead temperature and ink drop volume plotted against steady state pulse energy applied to heater resistors of a printhead.

In accordance with the invention, the controller 11 determines a thermal turn on pulse energy for the printhead 19 that is empirically related to a steady state drop volume turn on energy which is the minimum steady state pulse energy at which a heater resistor produces an ink drop of the proper volume, wherein pulse energy refers to the amount of energy provided by a voltage pulse; i.e., power multiplied by pulse width. In other words, increasing pulse energy beyond the drop volume turn on energy does not substantially increase drop volume. FIG. 2 sets forth a representative graph of normalized printhead temperature and normalized ink drop volume plotted against steady state pulse energy applied to each of the heater resistors of a thermal ink jet printhead. Discrete printhead temperatures are depicted by crosses (+) while drop volumes are depicted by hollow squares (□). The graph of FIG. 2 indicates three different phases of operation of the heater resistors of a printhead. The first phase is a non-nucleating phase wherein the energy is insufficient to cause nucleation. In the non-nucleating phase printhead temperature increases with increasing pulse energy while ink drop volume remains at zero. The next phase is the transition phase wherein the pulse energy is sufficient to cause ink drop forming nucleation for some but not all heater resistors, but the ink drops that are formed are not of the proper volume. In the transition phase the ink drop volume increases with increasing pulse energy, since more heater resistors are firing ink drops and the volume of the ink drops formed are approaching the appropriate drop volume, while the printhead temperature decreases with increasing pulse energy. The decrease in printhead temperature is due to transfer of heat from the printhead by the ink drops. The next phase is the mature phase wherein drop volume is relatively stable and temperature increases with increasing pulse energy. FIG. 2 shows only the lower energy portion of the mature phase, and it should be appreciated that printhead temperature increases with increased pulse energy since ink drop volume remains relatively constant in the mature phase.

In accordance with the invention, a printhead is tested for its thermal turn on energy generally as follows. The printhead is warmed to a temperature that is higher than would normally be achieved during printing, for example greater than the temperature that would be achieved by ink firing pulses having a predetermined reference pulse energy (described more particularly herein) and a pulse frequency that is equal to the intended operating frequency. For example, non-ink firing warming pulses can be applied to warm the printhead, wherein the warming pulses have an average power that is substantially equal to the average power of ink firing pulses having the predetermined reference pulse energy and a pulse frequency equal to the operating frequency. A continuous series of ink firing pulses at the predetermined pulse frequency is then applied to the printhead. The pulse energy of the ink firing pulses begins at the reference pulse energy and is stepwise decreased by steps of substantially constant duration, for example by incrementally decreasing the supply voltage and/or decreasing pulse width. The output of the temperature sensor is sampled for the different ink firing pulse energies applied to the heater resistors, for example at least one sample at each different ink firing pulse energy. For a properly operating printhead and temperature sensor, temperature data acquisition by stepwise pulse energy decrementing and temperature sampling continues until it is determined that acceptable temperature data has been produced. Generally, temperature data is acceptable if it decreases with decreasing pulse energy, reaches a minimum, and then increases to a point that is approximately 15° C. above the minimum temperature. The test is stopped pursuant to the temperature rise of approximately 15° C. to minimize ingestion of air by the printhead nozzles.

After the stepwise decrementing of pulse energy is stopped, ink firing pulses at the reference pulse energy are applied for a predetermined amount of time to clear the ink firing nozzles of any ingested air.

In accordance with the invention, acceptable temperature data is analyzed by determining the equation of a curve fitted to the temperature samples, for example a fifth order polynomial equation, and selecting as the turn on energy the pulse energy that is the least of the pulse energies that correspond to the peaks of the curvature of the approximation.

Figure 3:
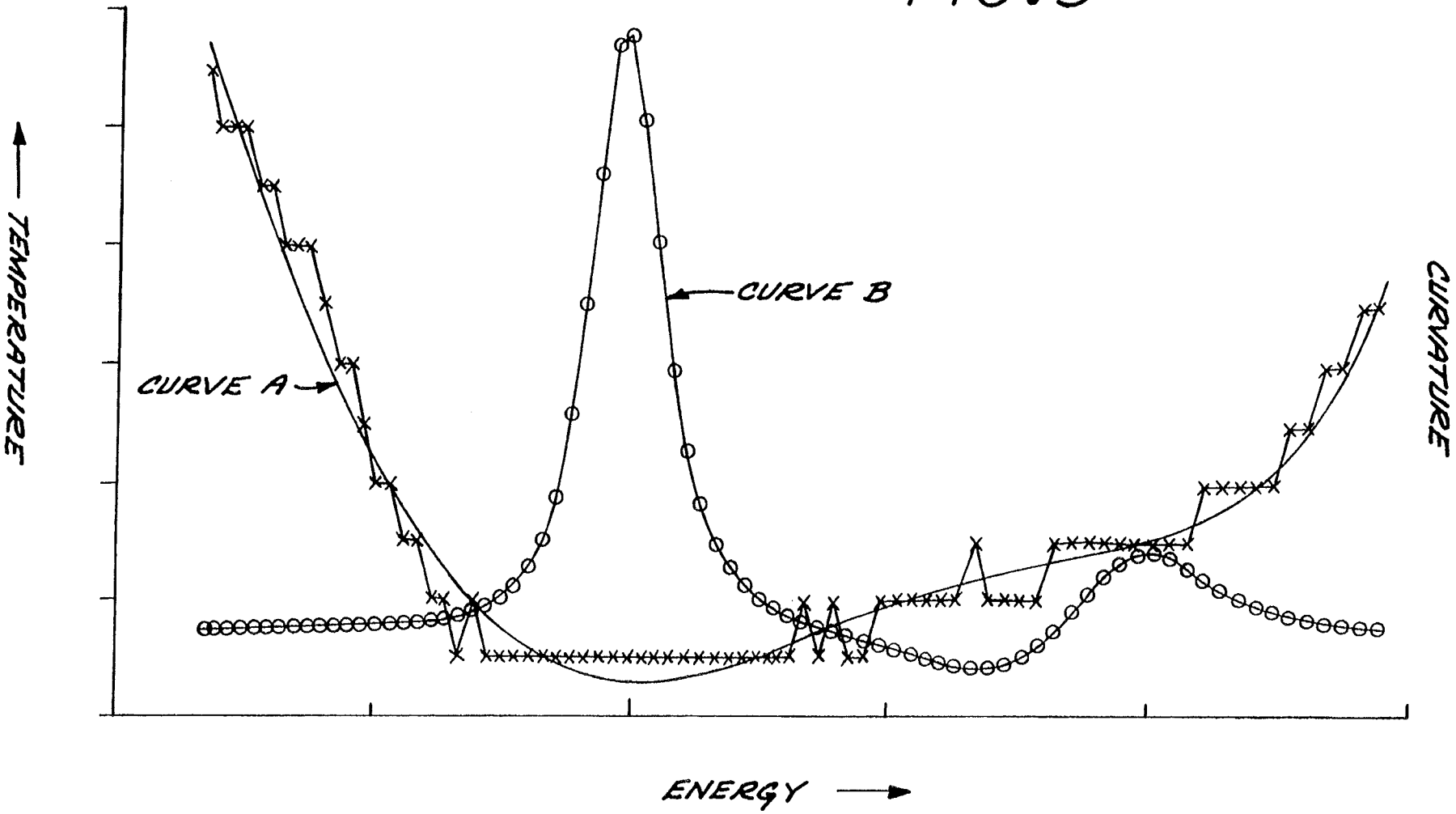
FIG. 3 schematically illustrates in graph form the analysis in accordance with the invention of the temperature response of a printhead to a time varying pulse energy ramp.
Figure 4A:
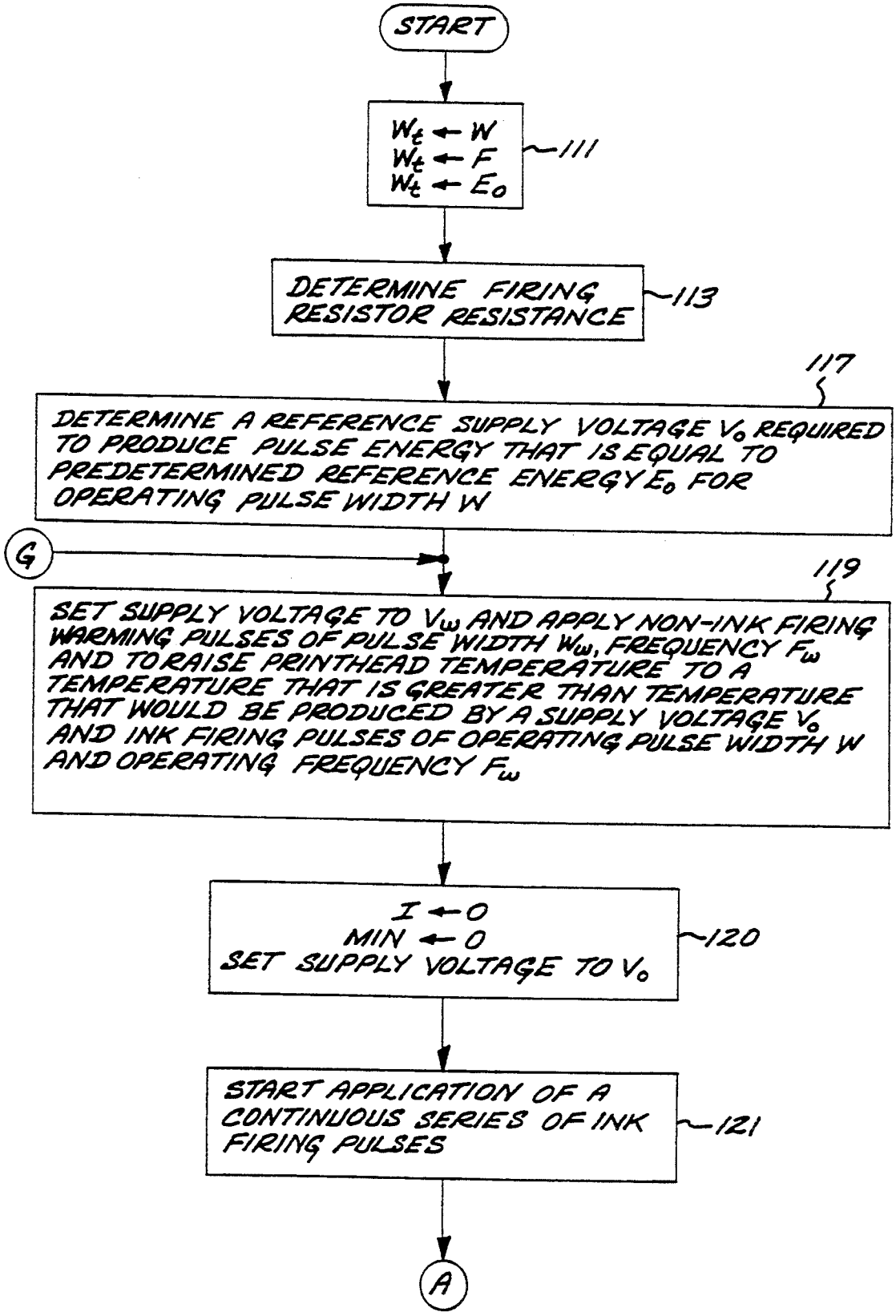
FIGS. 4A, 4B, 4C, and 4D set forth a flow diagram of a procedure for determining printhead turn on energy in accordance with the invention.
Figure 4B:
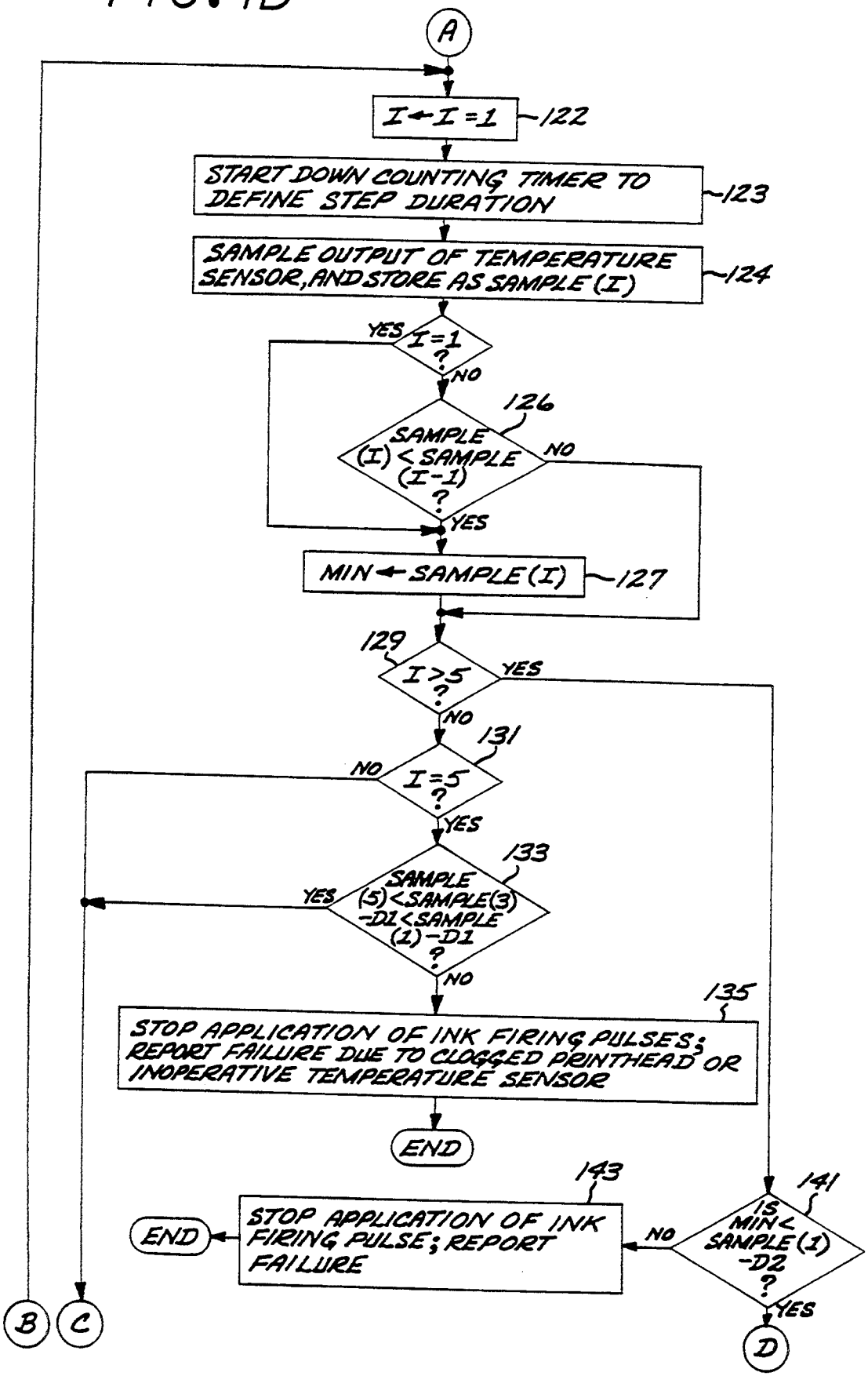
Figure 4C:
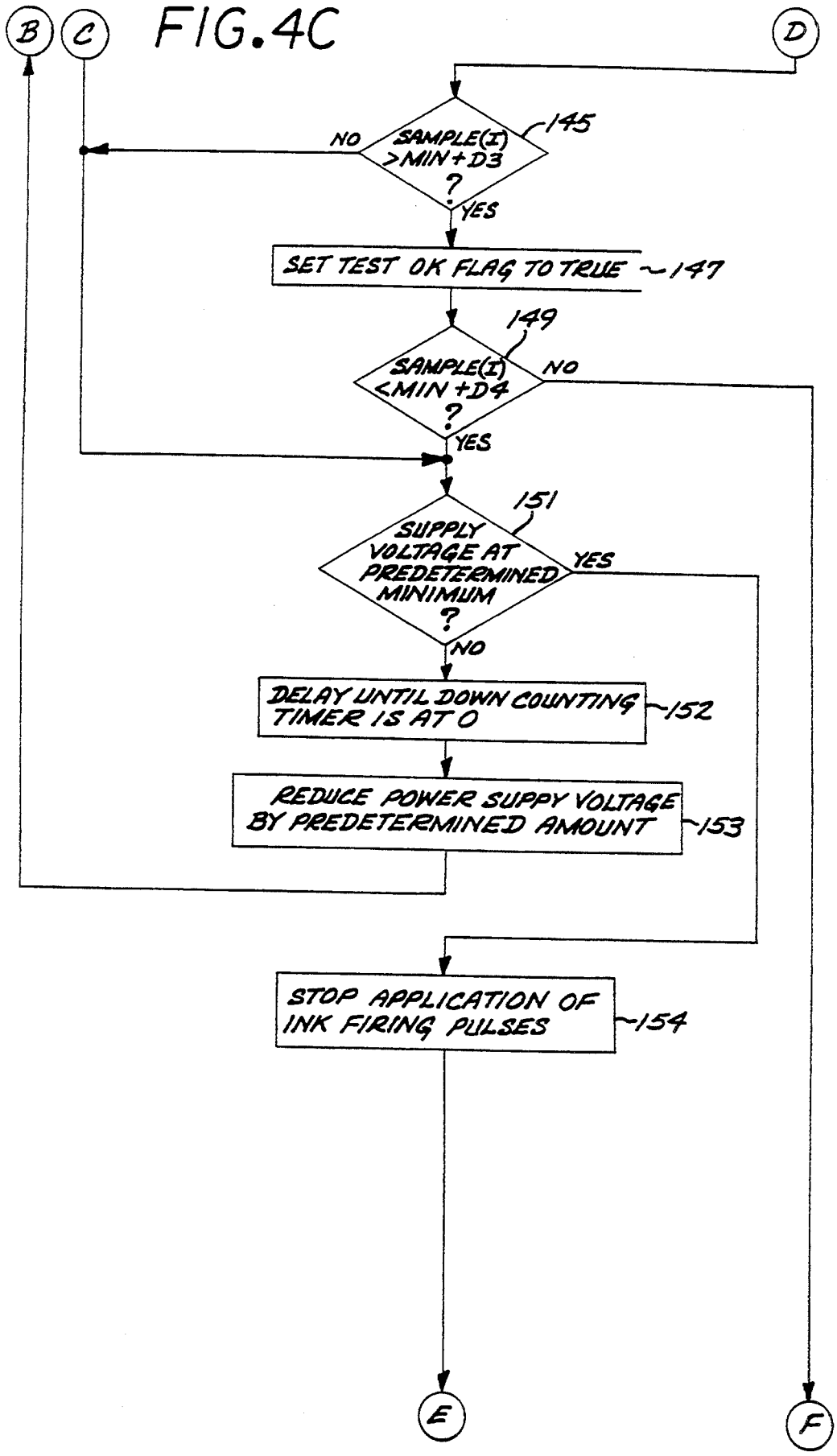
Figure 4D:
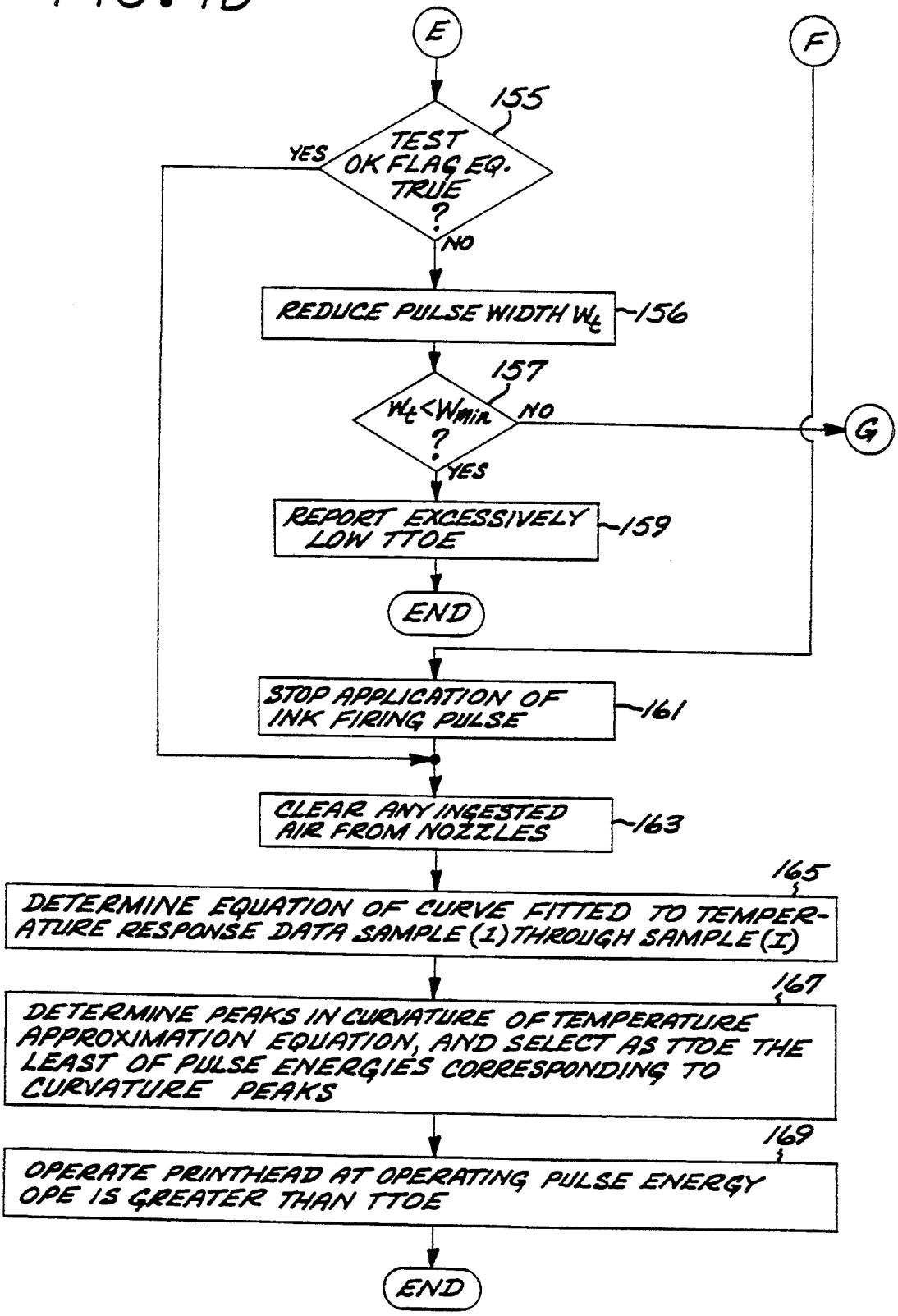

Referring now to FIG. 3, set forth therein is a representative response of a printhead to testing in accordance with the invention. The x's are temperature samples, and the curve A is the curve of the fifth order polynomial approximation of the temperature samples. The curve B is the curvature of the polynomial approximation represented by the curve A, and the small circles (o) are discrete evaluations of the curvature of the polynomial approximation. As can be seen, for acceptable temperature data, the curvature of the polynomial peaks at two places, and the leftmost peak occurs at the energy that is the least of the energies associated with the curvature peaks. In accordance with the invention the pulse energy associated with the leftmost peak is the thermal turn on energy.

In use, the thermal turn on energy measured in accordance with the invention is utilized to set the operating pulse energy of the ink firing pulses applied to the heater resistors, for example by setting the operating energy to be greater than the thermal turn on energy and within a range that insures proper print quality while avoiding premature failure of the heater resistors.

The reference pulse energy referred to previously in conjunction with the pulse energy at the start of the application of ink firing pulses is a nominal operating pulse energy that has been determined for the particular printhead design to be sufficient to insure that ink drops of the proper volume would be produced by all examples of that printhead design pursuant to voltage pulses having a pulse energy equal to the reference pulse energy. For example, the reference pulse energy can comprise a nominal operating energy that would be provided to the printhead if the disclosed turn on energy measurement is not performed, or if the test of the printhead produces unacceptable temperature. For the particular implementation wherein the printer of FIG. 1 is configured to print pursuant to application of ink firing voltage pulses having a fixed frequency F and a fixed pulse width W, the pulse energy of the voltage pulses will depend on the pad to pad resistance $R_p$ associated with each of the heater resistors and the pulse voltage VP of the voltage pulses as determined by the supply voltage $V_s$ and the voltage drop across the driver circuit. The pad to pad resistance associated with the heater resistors can be determined by the controller 11 pursuant to reading the sample resistor, and thus a reference pulse voltage $VP_o$ can be determined from the relation that energy is power multiplied by time, wherein time is the operating pulse width W. Power can be particularly expressed as voltage squared divided by resistance, wherein resistance is the pad to pad resistance $R_p$ associated with each heater resistor, and thus the reference pulse energy $E_o$ can be expressed as follows in terms of the pad to pad resistance $R_p$ and the reference pulse voltage $VP_o$ necessary to achieve the reference energy $E_o$:

$$E_o=(VP_o^2/R_p)*W \qquad \text{(Equation 3)}$$

Solving Equation 3 for the reference pulse voltage $VP_o$ results in:

$$VP_o=(E_o*R_p/W)^{\frac{1}{2}} \qquad \text{(Equation 4)}$$

By determining a reference pulse voltage $VP_o$ that would result in a pulse energy equal to a reference pulse energy $E_o$ for a fixed pulse width W effectively calibrates the printhead such that the pulse energy provided to the heater resistors is known and can be varied by changing the supply voltage $V_s$ which controls the pulse voltage VP. For the particular implementation wherein the pulse voltage VP is equal to the supply voltage $V_s$ reduced by a constant voltage drop $V_d$ of the driver circuit, the reference supply voltage $V_o$ is:

$$V_o=(VP_o+V_d) \qquad \text{(Equation 5)}$$

For the implementation wherein the driver circuit is better modelled as a resistor, the reference supply voltage $V_o$ is:

$$V_o=VP_o*(R_p+R_d)/R_p \qquad \text{(Equation 6)}$$

wherein $R_d$ is the resistance of the driver circuit and $R_p$ is the pad to pad resistance associated with a heater resistor.

As previously described, the non-ink firing warming pulses to the printhead to raise its temperature have an average power that is substantially equal to the average power of ink firing pulses having a pulse energy equal to the reference pulse energy $E_o$, and such warming pulses can conveniently have a voltage that is equal to the reference pulse voltage $VP_o$. The average power of the pulses provided to the heater resistors can be represented by the product of the pulse frequency and the pulse width, and therefore the equality between the average power of the warming pulses and the average power of the ink firing pulses having a pulse energy equal to the reference $E_o$ can be expressed as follows:

$$W_w*F_w=W*F \quad \text{(Equation 7)}$$

The pulse width $W_w$ of the warming pulses is selected to be sufficiently smaller than the fixed operating pulse width W so that drops are not formed pursuant to the warming pulse width $W_w$, and the appropriate warming pulse frequency $F_w$ is determined by solving Equation 5 for the warming pulse frequency $F_w$:

$$F_w=W*F/W_w \quad \text{(Equation 8)}$$

Referring now to FIGS. 4A, 4B, 4C and 4D, set forth therein is a flow diagram of a procedure in accordance with the invention for determining thermal turn on energy (TTOE) in accordance with the invention. At 111 various variables are initialized. In particular, a test pulse width $W_t$ is set to the fixed operating pulse width W, and a test pulse frequency $F_t$ is set to the fixed operating frequency F. At 113 the resistance of the sample resistor is determined, and at 117 a reference supply voltage $V_o$ that would provide a pulse energy equal to a predetermined reference pulse energy $E_o$ for the test pulse width $W_t$ is determined, for example as described above. At 119 the supply voltage is set to a warming supply voltage $V_w$, and warming pulses of width $W_w$ and frequency $F_w$ are applied to the printhead to raise the temperature of the printhead to a temperature that is higher than the temperature that would be produced by a supply voltage equal to the reference supply voltage $V_o$ and ink firing pulses of the operating width W and the operating frequency F. For example, the warming supply voltage can be equal to the reference supply voltage $V_o$, and the pulse width $W_w$ and the pulse frequency $F_w$ of the warming pulses can be determined as described previously. Alternatively, the warming supply voltage $V_w$ can be greater than the reference supply voltage $V_o$ while maintaining the pulse width $W_w$ and the pulse frequency $F_w$ at the values calculated for a supply voltage of $V_o$. By way of illustrative example, the warming pulses can be applied for a predetermined amount of time that is known to sufficiently raise the temperature of the printhead, or the output of the temperature sensor can be monitored to apply the warming pulses until a predetermined temperature is reached.

At 120 a sample count I is initialized to 0, a minimum temperature MIN is initialized to 0, and the voltage controlled power supply is set to produce the reference voltage $V_o$. At 121 application of a continuous series ink firing pulses is started, and at 122 the sample count I is incremented by 1. At 123 a down counting timer is started to define an energy step duration. For example, a down counter can be initialized with a predetermined count that corresponds to the desired energy step duration.

At 124 the output of the A/D for the temperature sensor is sampled, and the sampled output is stored as SAMPLE(I). At 125 a determination is made as to whether the sample count I is equal to 1. If yes, control transfers to 127 where minimum temperature sample MIN is set to the current temperature SAMPLE(I). If the determination at 125 is no, at 126 a determination is made as to whether the current temperature SAMPLE(I) is less than the prior SAMPLE(I-1). If no, control transfers to 129, described further herein. If the determination at 126 is yes, at 127 the minimum temperature sample MIN is set to the current temperature SAMPLE(I).

At 129 a determination is made as to whether the sample count I is greater than 5. If yes, control transfers to 141, described below. If the determination at 129 is no, a determination is made at 131 as to whether the sample count I is equal to 5. If no, control transfers to 151, described below. If the determination at 131 is yes, at 133 a determination is made as to whether the temperature SAMPLE(5) is less than the A/D temperature SAMPLE(3) reduced by D1, wherein D1 is the number of A/D counts that represents about 2 degrees C., and whether the A/D temperature SAMPLE(3) reduced by D1 is less than the A/D temperature SAMPLE(1) reduced by D1, wherein D1 is at least 1 A/D count. If both conditions are met, control transfers to 151, described further below. If the conditions of the determination at 133 are not met, at 135 the application of ink firing pulses is stopped, a failure due to a clogged printhead or an inoperative temperature sensor is reported, and the procedure ends.

At 141 a determination is made as to whether the minimum temperature sample MIN is less than the first temperature SAMPLE(I) reduced by D2, wherein in D2 is the number of A/D counts that represents about 9 degrees C. If no, at 143 application of ink firing pulses is stopped, a failure is reported, and the procedure ends. If the determination at 141 is yes, at 145 a determination is made as to whether the current SAMPLE(I) is greater than the present minimum temperature sample MIN plus D3, wherein D3 is the number of A/D counts that represents about 9 degrees C., for example. If no, control transfers to 151, described further herein. If the determination at 145 is yes, at 147 a test OK flag is set to true, and at 149 a determination is made as to whether the current SAMPLE(I) is less than the present minimum temperature sample MIN plus D4, wherein D4 is the number of A/D counts that represents about 13 degrees C., for example. If no, control transfers to 161, described further herein.

If the determination at 149 is yes, at 151 a determination is made as to whether the supply voltage $V_s$ is at a predetermined minimum. If yes, control transfers to 154, described further herein. If the determination at 151 is no, at 152 the procedure is delayed until the step duration timer is at zero, and then at 153 the controlled voltage supply is adjusted to reduce the supply voltage by a predetermined increment. Control then transfers to 123, described previously.

At 154 the application of ink firing pulses is stopped, and at 155 a determination is made as to whether the test OK flag is in the true state. If yes, control transfers to 163, described further herein. If the determination at 155 is no, at 156 the test pulse width $W_t$ is reduced, and at 157 a determination is made as to whether the test pulse width $W_t$ is less than a predetermined test pulse minimum width $W_{min}$. If no, control transfers to 119 so that the printhead can be tested at a reduced pulse energy. If the determination at 157 is yes, at 159 a failure due to excessively low thermal turn on energy is reported, and the procedure ends.

At 161 the application of ink firing pulses is stopped, and at 163 any air ingested by the nozzles is cleared by setting the supply voltage to the reference supply voltage $V_o$ and applying voltage pulses of operating width W and operating frequency F. At 165 an equation of a curve fitted to the temperature response data SAM- PLE(l) through SAMPLE(I) is determined from the temperature response data and the respective supply voltages, pulse voltages, or pulse energies that produced the respective temperature response data, for example a best fit fifth order polynomial that defines temperature as a function of supply voltage, pulse voltage, or pulse energy. The supply voltage for each SAMPLE is simply the supply voltage that resulted in a particular temperature SAMPLE, while the pulse voltage for each sample is calculated by Equations 1 or 2, depending upon implementation, from the corresponding supply voltage. Pulse energy E can be calculated as follows from the calculated pulse voltage VP:

$$E=(VP^2/R_p)*W \quad \text{(Equation 9)}$$

wherein $R_p$ is the pad to pad resistance of each heater resistor and W is the width of the pulse voltage VP applied to the heater resistors to render a particular SAMPLE(I).

At 167 the peaks in the curvature of the temperature approximation equation (which can be temperature as a function of supply voltage, pulse voltage or pulse energy) are determined, for example by conventional techniques such as the evaluating the well known curvature formula $k(x)=f''(x)/[1+(f'(x))^2]^{3/2}$ and determining the maxima, wherein k(x) is curvature, f''(x) is the second derivative of the temperature approximation equation, and f'(x) is the first derivative of the temperature approximation equation. The least of the supply voltages, pulse voltages or pulse energies corresponding to the curvature maxima is selected as the thermal turn on supply voltage $V_{s(ttoe)}$, the thermal turn on pulse voltage $VP_{ttoe}$, or the thermal turn on energy $E_{ttoe}$, depending on the independent variable selected for the approximation equation.

At 169 the printhead is operated at an operating pulse energy OPE that is greater than the thermal turn on energy $E_{ttoe}$ determined at 167, for example in a range that insures a desired print quality while avoiding premature heater resistor failure.

By way of illustrative example, it has been determined empirically that drop volume turn on energy $E_{dv}$, described earlier with respect to FIG. 2, is linearly related to thermal turn on energy $E_{ttoe}$ as determined in accordance with the invention, and the operating energy $E_{op}$ can be selected as a percentage of the drop volume turn on energy. Once such selection of operating energy has been made, the desired operating supply voltage can be determined from the thermal turn on supply voltage $V_{s(ttoe)}$, the thermal turn on pulse voltage $VP_{ttoe}$, or the thermal turn on energy $E_{ttoe}$ determined in accordance with the invention.

In particular, drop volume turn on energy $E_{dv}$ is related to thermal turn on energy $E_{ttoe}$ as follows:

$$E_{dv}=m*E_{ttoe}+b \quad \text{(Equation 10)}$$

wherein the slope m and the intercept b are empirically determined for each particular pen design, for example by linear regression of experimentally determined $E_{ttoe}$ and $E_{dv}$ data for a sufficiently large number of pens of the particular pen design. The drop volume turn on energy of each pen of the sample is determined by measuring the average ink drop volume of the pen at different pulse energies, starting with a pulse energy that is sufficiently greater than the expected drop volume turn on energy of the pen. For example, at each pulse energy a predetermined number of pulses are applied to a nozzle, and an average ink drop weight is determined from the weight lost by the pen pursuant to firing ink drops in response to the predetermined number of pulses. An average drop volume is determined then from the calculated average drop weight. The average ink drop volume data for each pen in the sample is analyzed to determine the minimum energy at which mature drops are formed, and such minimum energy is regarded as the drop volume turn on energy for that particular pen. Drop volume turn on energy measurement can be accomplished in a research setting, but is difficult to adapt to production manufacturing, and moreover cannot be readily performed in an automated manner by a printer that is at its installed location.

If the operating energy $E_{op}$ is desired to be K percent over the drop volume turn on energy, then:

$$E_{op}=(1+K/100)*TOE_{dv} \quad \text{(Equation 11)}$$

Since $E_{dv}$ is related to $E_{ttoe}$, the desired operating energy $E_{op}$ can be expressed in terms of the thermal turn on energy $E_{ttoe}$ determined in accordance with the invention:

$$E_{op}=(1+K/100)\ (m*E_{ttoe}+b) \quad \text{(Equation 12)}$$

Pursuant to Equation 9, the desired operating energy $E_{op}$ can also be expressed in terms of the desired operating pulse voltage $VP_{op}$ at a heater resistor:

$$E_{op}=(VP_{op}^2/R_p)*W \quad \text{(Equation 13)}$$

The thermal turn on energy $E_{ttoe}$ can be expressed as follows in terms of the turn on pulse voltage $VP_{ttoe}$ at a heater resistor:

$$E_{ttoe}=VP_{ttoe}^2(W)/R_p \quad \text{(Equation 14)}$$

wherein W is pulse width and $R_p$ is the pad to pad resistance of a heater resistor.

By substituting Equation 14 in Equation 12, combining the resulting equation with Equation 13, and solving for the operating pulse voltage at a heater resistor, the following equation is derived:

$$VP_{op}[(1+K/100)\ (m(VP_{ttoe}^2)\ (W)/R_p+b)*R_p/W]^{\frac{1}{2}} \quad \text{(Equation 15)}$$

The pulse voltage VP at a heater resistor is related to the supply voltage $V_s$ as set forth in Equations 1 or 2, and thus the thermal turn on pulse energy $VP_{ttoe}$ can be expressed in terms of the turn on supply voltage $V_{s(ttoe)}$ pursuant to one of Equations 1 or 2, depending upon implementation. The appropriate expression for the thermal turn on pulse energy $VP_{ttoe}$ is substituted in Equation 15, which is then solved for the desired operating supply voltage $V_{s(op)}$ that will provide the desired operating pulse energy to a heater resistor. For the particular example wherein the driver circuit is modelled as a resistor $R_d$, the desired operating supply voltage $V_{s(op)}$ is:

$$V_{s(op)} = [(R_p + R_d)/R_p]*\{(R_p/W)\ (1 + K/100)[m(V^2_{s(ttoe)})(W)(R_p)/(R_p + R_d)^2] + b\}^{\frac{1}{2}} \quad \text{(Equation 16)}$$

Simplifying the foregoing provides:

$$V_{s(op)} = \{(1 + K/100)(m)(V^2_{s(ttoe)}) + \quad \text{(Equation 17)}$$

-continued $$(1 + K/100)[(R_p + R_d)^2/(R_p * W)] * b\}^{\frac{1}{2}}$$

wherein the turn on supply voltage $V_{s(ttoe)}$ is calculated from the thermal turn on energy $E_{ttoe}$ in accordance with Equation 14 combined with Equation 2, and wherein W is the pulse width utilized to generate the temperature samples from which the temperature approximation curve was determined.

In Equation 17, the resistances do not appear in the first and largest term, which is helpful since the resistances of the driver and the heater resistor may not be precisely known. Moreover, Equation 17 expresses the operating supply voltage $V_{s(op)}$ in terms of the thermal turn on supply voltage that provided the thermal turn on energy $E_{ttoe}$, which allows an operating supply voltage to be determined without explicit calculation of pulse voltage or pulse energy, where the operating pulse width is the same as the pulse width utilized in determining thermal turn on supply voltage, thermal turn on pulse voltage, or thermal turn on energy in accordance with the invention. In other words, the thermal turn on supply voltage can be determined in accordance with the invention, and an operating energy as a percentage of drop volume turn on energy is determined without expressly determining drop volume turn on energy, thermal turn on pulse voltage or thermal turn on energy.

The procedure of FIGS. 4A, 4B, 4C, and 4D can be generally described as follows. The resistance of the firing resistors is determined, and a reference supply voltage is determined so that ink firing pulses of a predetermined reference pulse energy $E_o$ can be provided to the heater resistors. The printhead is warmed to a temperature that is at least as high as the steady state temperature would be achieved with ink firing pulses having a pulse energy equal to the reference pulse energy. After warming, a continuous series of ink firing pulses are applied to the heater resistors. The pulse energy of the series of ink firing pulses starts with a pulse energy that is equal to the reference pulse energy $E_o$ and is stepwise decreased with a substantially constant step duration. In other words, the continuous series of ink firing pulses is organized into a sequence of groups of pulses wherein each pulse group has a constant pulse energy and a pulse group interval that is the same for each of the groups. At each energy step, the printhead temperature is detected, for example pursuant to one or more samples, and the detected printhead temperature is stored. For the first four decreasing pulse energy levels, samples are stored but not analyzed. Pursuant to the fifth temperature sample, the first five temperature samples are analyzed to determine whether the temperature samples are decreasing with energy. If the temperature samples are decreasing with energy, the test proceeds. If the first five temperature samples are not decreasing with energy, then a failure is reported. The failure could be due to a printhead having a large number of clogged nozzles, or a failed temperature sensor.

If the trend of the first five temperature samples is downward, pulse energy continues to be incrementally decreased and respective samples are taken. Temperature data acquisition continues until (1) the voltage output of the controlled power supply has been decreased to its minimum voltage, or (2) the most recent temperature sample exceeds the detected minimum temperature sample by a predetermined amount. The acquired data is considered acceptable if the last temperature sample taken exceeded the detected minimum by a predetermined amount that is less than the predetermined amount utilized to terminate temperature data acquisition. If the last temperature sample did not exceed the detected minimum by such predetermined amount, the printhead is considered to have a relatively low turn on energy, and the test is repeated with a shorter test pulse.

After acceptable temperature data is acquired, it is analyzed to determine the thermal turn on energy.

The procedure of FIGS. 4A, 4B, 4C, and 4D effectively analyzes the temperature data as it is being generated, and the test is terminated if the temperature data clearly indicates unacceptable data. Further, the procedure insures that the range of pulse energies utilized is proper for the printhead being tested by requiring that the last temperature sample exceed the detected minimum sample value by a predetermined amount.

While the procedure of FIGS. 4A, 4B, 4C, and 4D includes the step of determining the resistance of the heater resistors for purposes of energy calculation, it should be appreciated that thermal turn on energy can be determined on the basis of a nominal resistance of the heater resistors, where such nominal resistance is typically determined as part of the design of the printhead. In that regard, the procedure of FIGS. 4A, 4B, 4C, and 4D would be modified to remove the step of determining a reference supply voltage $V_o$, and the supply voltage would be set to a predetermined reference voltage $V_o$ that is greater than the highest expected thermal turn on supply voltage for the particular printhead.

The foregoing has been a disclosure of a thermal ink jet printer that advantageously determines a thermal turn on energy of a thermal ink jet printhead while the printhead is installed in the printer and operates at a pulse energy that is based on the determined thermal turn on energy. Pursuant to the invention, print quality and useful printhead life are optimized.

Although the foregoing has been a description and illustration of specific embodiments of the invention, various modifications and changes thereto can be made by persons skilled in the art without departing from the scope and spirit of the invention as defined by the following claims.

What is claimed is:

1. A method for operating a thermal ink jet printer including a printhead having ink firing heater resistors responsive to pulses provided to the printhead, comprising the steps of:

applying to the printhead non-ink firing warming pulses to warm the printhead to a temperature that is higher than a temperature that would be produced pursuant to ink firing pulses of a predetermined reference pulse energy and a predetermined pulse frequency;

applying to the heater resistors on the printhead ink firing pulses having a pulse energy substantially equal to the predetermined reference pulse energy and a pulse frequency equal to the predetermined pulse frequency;

incrementally decreasing the pulse energy of the ink firing pulses such that ink firing pulses of decreasing pulse energies are applied to the heater resistors on the printhead, starting with a pulse energy substantially equal the predetermined reference energy;

sampling the temperature of the printhead while the ink firing pulses are applied to the ink firing resistors to produce a set of temperature samples respectively associated with the decreasing pulse energies;

determining a temperature approximation equation for a curve that is fitted to the temperature samples, wherein the approximation equation defines temperature as a function of pulse energy, the temperature approximation equation having a curvature associated therewith;

determining a thermal turn on energy from the curvature of the temperature approximation equation; and operating the printhead at a pulse energy that is greater than the thermal turn on energy and in a range that provides a desired print quality while avoiding premature failure of the heater resistors.

2. The method of claim 1 wherein the step of determining a thermal turn on energy comprises the steps of:

determining peaks in the curvature of the temperature approximation equation and determining pulse energies corresponding to the curvature peaks; and selecting as the thermal turn on energy a pulse energy that is a least pulse energy of pulse energies corresponding to the curvature peaks.

3. A method for operating a thermal ink jet printer including a printhead having heater resistors responsive to pulses provided to the printhead, comprising the steps of:

applying to the printhead non-ink firing warming pulses to warm the printhead to a temperature that is higher than a temperature that would be produced pursuant to ink firing pulses of a predetermined voltage, a predetermined pulse width, and a predetermined pulse frequency;

applying to the heater resistors on the printhead ink firing pulses of the predetermined voltage, the predetermined pulse width, and the predetermined pulse frequency;

incrementally decreasing the voltage of the ink firing pulses such that ink firing pulses of decreasing voltages, but of the predetermined pulse width and the predetermined pulse frequency, are applied to the ink firing resistors on the printhead, starting with a voltage substantially equal the predetermined voltage;

sampling the temperature of the printhead while the ink firing pulses are applied to the ink firing resistors to produce a set of temperature samples respectively associated with the decreasing voltages;

determining a temperature approximation equation for a curve that is fitted to the temperature samples, wherein the approximation equation defines temperature as a function of voltage, the temperature approximation equation having a curvature associated therewith;

determining a thermal turn on voltage from the curvature of the temperature approximation equation; and operating the printhead with ink firing pulses having a voltage that is greater than the voltage associated with the thermal turn on energy and in a range that provides a desired print quality while avoiding premature failure of the heater resistors.

4. The method of claim 3 wherein the step of determining a thermal turn on voltage comprises the steps of:

determining peaks in the curvature of the temperature approximation equation and determining voltages corresponding to the curvature peaks; and selecting as the thermal turn on voltage a voltage that is a least voltage of voltages corresponding to the curvature peaks.

5. A method for operating a thermal ink jet printer including a printhead having ink firing heater resistors responsive to pulses provided to the printhead, comprising the steps of:

applying to the printhead non-ink firing warming pulses to warm the printhead to a temperature that is higher than a temperature that would be produced pursuant to ink firing pulses of a predetermined reference pulse energy and a predetermined pulse frequency;

applying to the heater resistors on the printhead ink firing pulses having a pulse energy substantially equal to the predetermined reference pulse energy and a pulse frequency equal to the predetermined pulse frequency;

incrementally decreasing the pulse energy of the ink firing pulses such that ink firing pulses of decreasing pulse energies are applied to the heater resistors on the printhead, starting with a pulse energy substantially equal the predetermined reference energy;

sampling the temperature of the printhead while the ink firing pulses are applied to the ink firing resistors to produce a set of temperature samples respectively associated with the decreasing pulse energies;

determining a thermal turn on energy from the temperature data samples; and operating the printhead at a pulse energy that is greater than the thermal turn on energy and in a range that provides a desired print quality while avoiding premature failure of the heater resistors.

6. A method for operating a thermal ink jet printer including a printhead having heater resistors responsive to pulses provided to the printhead, comprising the steps of:

applying to the printhead non-ink firing warming pulses to warm the printhead to a temperature that is at least as high as a temperature that would be produced pursuant to ink firing pulses of a predetermined reference pulse energy and a predetermined pulse frequency;

applying to the printhead a continuous series of ink firing pulses having a pulse frequency equal to the predetermined pulse frequency and organized into a sequence of groups of pulses of decreasing energy wherein each group of pulses has a substantially constant pulse energy and a pulse group interval that is the same for each of the groups of pulses, and wherein the first pulse group has a pulse energy equal to the predetermined reference pulse energy;

obtaining a respective sample of the printhead temperature during each group of pulses to produce to produce a set of temperature samples respectively associated with the decreasing pulse energies;

determining a temperature approximation equation for a curve that is fitted to the temperature samples, wherein the approximation equation defines temperature as a function of pulse energy;

determining a thermal turn on pulse energy from the temperature approximation equation; and operating the printhead with ink firing pulses having a pulse energy that is greater than the thermal turn on pulse energy and in a range that provides a desired print quality while avoiding premature failure of the heater resistors.

* * * * *